US005836223A

United States Patent [19]

Lin

[11] Patent Number: 5,836,223

[45] Date of Patent: Nov. 17, 1998

[54] LENGTH-ADJUSTABLE SCREWDRIVER

[76] Inventor: Ching-Chou Lin, No. 33-12. Lane 320, Sec. 1, Sha-Tien Rd., Ta-Tu Hsiang, Taichung Hsien, Taiwan

[21] Appl. No.: 882,145

[22] Filed: Jun. 25, 1997

[51] Int. Cl.[6] ..... B25B 13/48

[52] U.S. Cl. ..... 81/436; 81/438; 81/177.2

[58] Field of Search ..... 81/436, 177.2, 81/177.1, 438, 439

*Primary Examiner*—James G. Smith
*Assistant Examiner*—Benjamin M. Halpern
*Attorney, Agent, or Firm*—Bacon & Thomas, PLLC

[57] ABSTRACT

A length-adjustable screwdriver including a handle having a polygonal center hole, a polygonal tube slidably mounted in the polygonal center hole of the handle, a collar block controlled by a chuck to lock the polygonal tube at the desired location, a shaft mounted in the polygonal tube and having a magnet at its front end adapted for securing a tool bit at the front end of the polygonal tube by magnetic attraction, and a sleeve slidably sleeved onto the polygonal tube, the sleeve having a spring-supported ball forced into engagement with one of a longitudinal series of locating holes of the polygonal tube to secure the sleeve at the desired location and a polygonal center through hole adapted for holding a tool bit when the front end of the sleeve protrudes over the front end of the polygonal tube.

2 Claims, 7 Drawing Sheets

LENGTH-ADJUSTABLE SCREWDRIVER

BACKGROUND OF THE INVENTION

The present invention relates to screwdrivers, and more particularly to such a screwdriver which can be conveniently adjusted to the desired length to hold any of a variety of tool bits of different sizes.

A regular screwdriver, as shown in FIG. 1, is generally comprised of a handle, a direction control block, a socket fastened to the handle and controlled by the direction control block to hold a tool bit. This structure of screwdriver can only turn a tool bit of a particular size. Further, the total length (arm of force) of the screwdriver is not adjustable.

SUMMARY OF THE INVENTION

It is one object of the present invention to provide a screwdriver which can be conveniently adjusted to change its total length. It is another object of the present invention to provide a screwdriver which can be used with a variety of tool bits of different sizes. To achieve these and other objects of the present invention, there is provided a length-adjustable screwdriver which comprises a handle having a polygonal center hole, a polygonal tube slidably mounted in the polygonal center hole of the handle, a collar block controlled by a chuck to lock the polygonal tube at the desired location, a shaft mounted in the polygonal tube and having a magnet at its front end adapted for securing a tool bit at the front end of the polygonal tube by magnetic attraction, and a sleeve slidably sleeved onto the polygonal tube, the sleeve having a spring-supported ball forced into engagement with one of a longitudinal series of locating holes of the polygonal tube to secure the sleeve at the desired location and a polygonal center through hole adapted for holding a tool bit when the front end of the sleeve protrudes over the front end of the polygonal tube.

DETAILED DESCRIPTION OF THE PREFERRED EMBODIMENT

Figure 1:
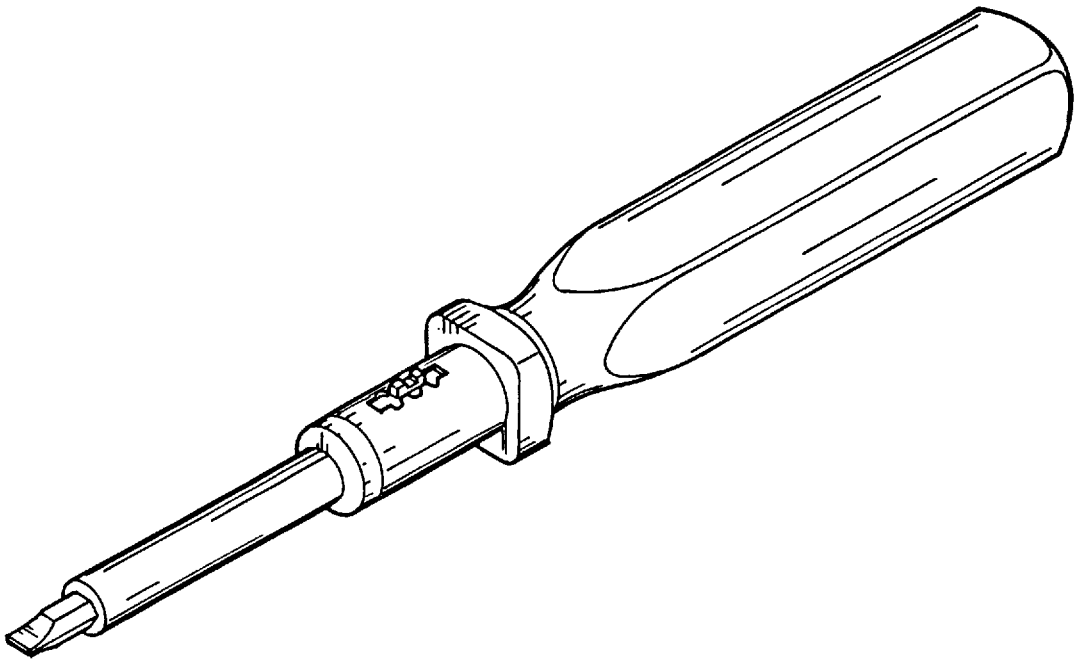
Fig. 1 PRIOR ART
FIG. 1 is an elevational view of a screwdriver according to the prior art.
Figure 2A:
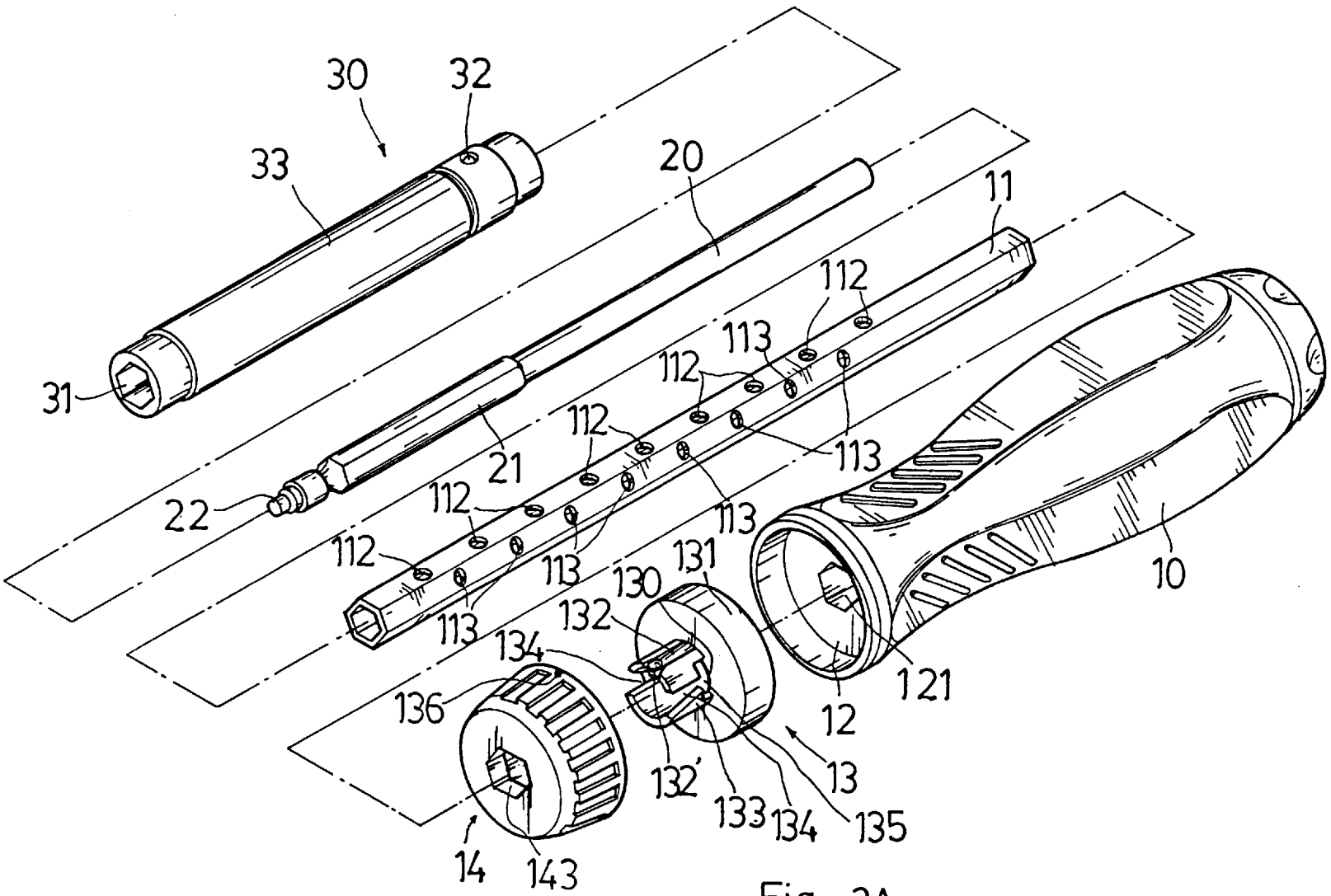
FIG. 2A is an exploded view of a screwdriver according to the present invention.
Figure 2B:
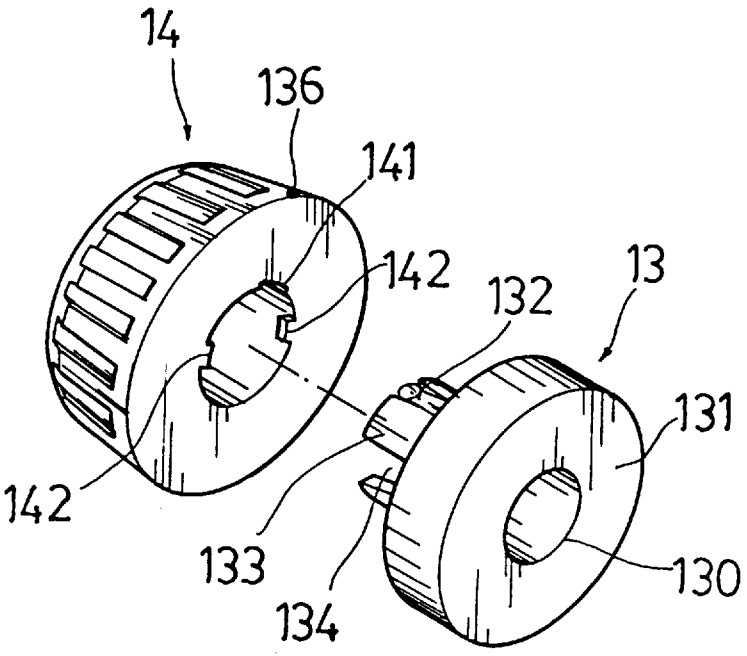
FIG. 2B is a perspective view of the collar block and the chuck according to the present invention.
Figure 3:
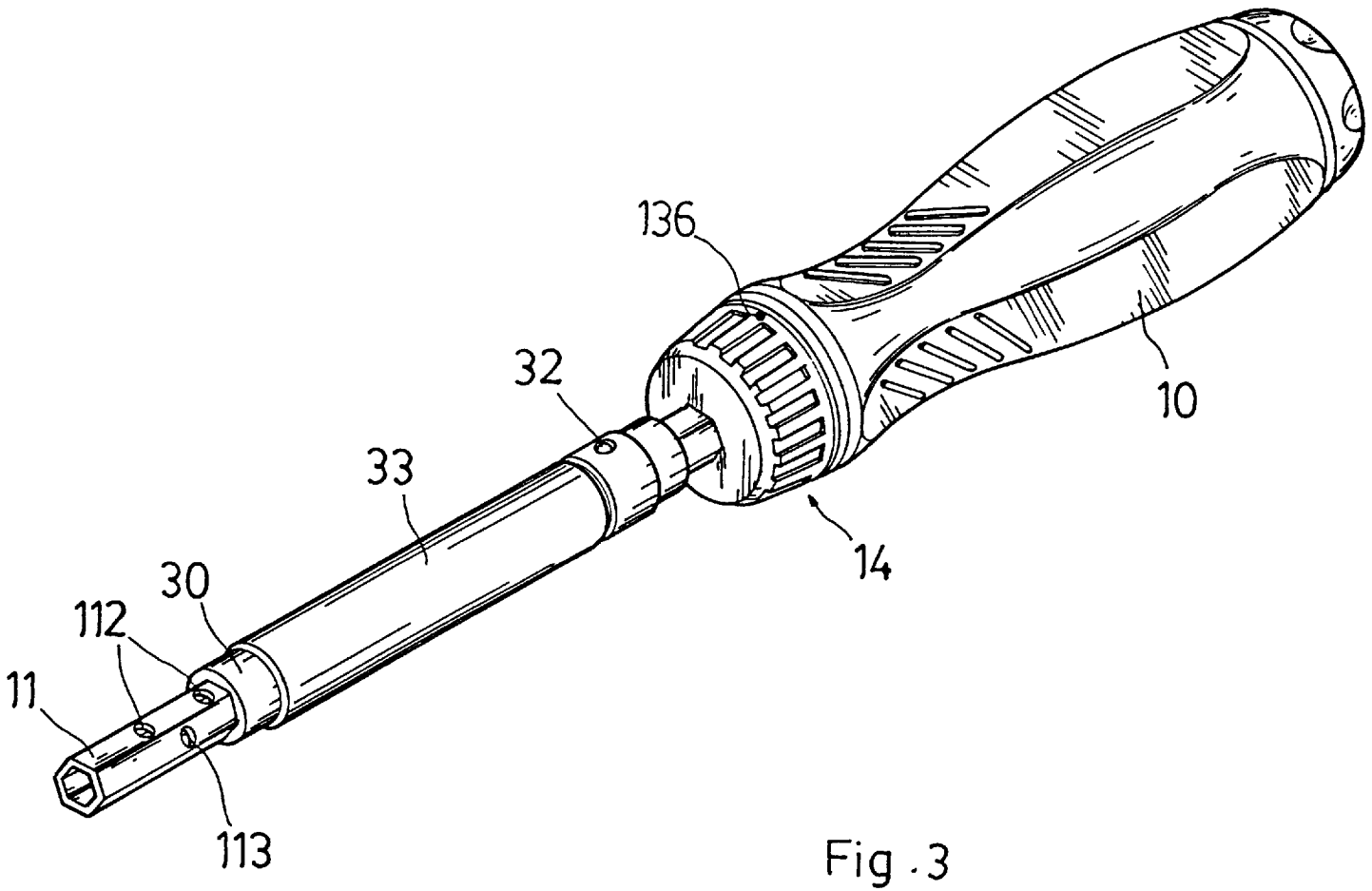
FIG. 3 is an elevational assembly view of the screwdriver shown in FIG. 2A.

Referring to FIGS. 2A, 2B, 3 and 4, a length-adjustable screwdriver in accordance with the present invention is generally comprised of a handle 10, a collar block 13, a chuck 14, a polygonal tube 11, a shaft 20, and a sleeve 30.

The handle 10 comprises a recessed circular front hole 12 at its front end, and a polygonal center hole 121 longitudinally disposed at the center of the recessed circular front hole 12.

The collar block 13 is mounted within the recessed circular front hole 12 of the handle 10, comprising a circular base 131 fit into the recessed front hole 12 of the handle 10, a center through hole 130 through the center of the circular base 131 in alignment with the polygonal center hole 121 of the handle 10, a tubular upright flange 133 raised from one side of the circular base 131 around the center through hole 130, two transverse slots 135 bilaterally disposed at the connecting area between the circular base 131 and the upright flange 133, two longitudinal openings 134 respectively and perpendicularly extended from the transverse slots 135 which separate the tubular upright flange 133 into two symmetrical halves, a springy strip 132 raised from the circular base 131 at an outer side of the upright flange 133 and having a top end terminating in a semicircular retainer head 132'. Further, one half of the upright flange 133 has a longitudinal gap (not shown) through which the springy strip 132 can be forced to bend toward the longitudinal center of the collar block 13.

The chuck 14 is an annular member fitting over the front end of the handle 10, having a center through hole 143, a longitudinal groove 141 longitudinally disposed inside the center through hole 143, and two inward guide rods 142 bilaterally and inwardly raised from the periphery of the center through hole 143 at its bottom side. The chuck 14 is coupled to the collar block 13 by inserting the two inward guide rods 142 through the longitudinal openings 134 into the transverse slots 135 and then turning the chuck 14 in one direction.

The polygonal tube 11 is inserted through the center through hole 143 of the chuck 14 and the center through hole 130 of the collar block 13 into the polygonal center hole 121 of the handle 10, having an inside annular flange 111, and two longitudinal rows of locating holes 112; 113 alternatively arranged at two adjacent side walls thereof. When the polygonal tube 11 is installed, it can be turned with the handle 10 (because the cross section of the polygonal tube 11 fits the cross section of the polygonal center hole 121 of the handle 10. By turning the chuck 14 relative to the collar block 13, the polygonal tube 11 is locked/unlocked. When the chuck 14 is turned in one direction to let the springy strip 132 be received in the longitudinal groove 141 of the chuck 14, the polygonal tube 11 is released and can be moved longitudinally relative to the handle 10; when the chuck 14 is turned in the reversed direction to force its longitudinal groove 141 away from the springy strip 132, the retainer head 132' of the springy strip 132 is forced into engagement with one locating hole 112 of the polygonal tube 11, and therefore the polygonal tube 11 is locked. Further, the chuck 14 has a mark 136 on its outside wall corresponding to the longitudinal groove 141 for quick positioning of the springy strip 132 in the longitudinal sliding groove 141.

The shaft 20 is a round rod inserted into the polygonal tube 11, having a polygonal rod section 21 at one end fitting the cross section of the inner diameter of the polygonal tube 11 and a magnet 22 at the end of the polygonal rod section 21. When the shaft 20 is inserted into the polygonal tube 11, the polygonal rod section 21 is stopped at the inside annular flange 111 of the polygonal tube 11. After the installation of the shaft 20 in the polygonal tube 11, a tool bit 40 is attached to the front end of the polygonal tube 11 and secured in place by the magnetic attractive force of the magnet 22.

The sleeve 30 is round tube covered with a soft covering 33, having a polygonal center through hole 31 fitting the polygonal outer diameter of the polygonal tube 11, and a spring-supported ball 32 adapted to engage one locating hole 113 of the polygonal tube 11.

Figure 4:
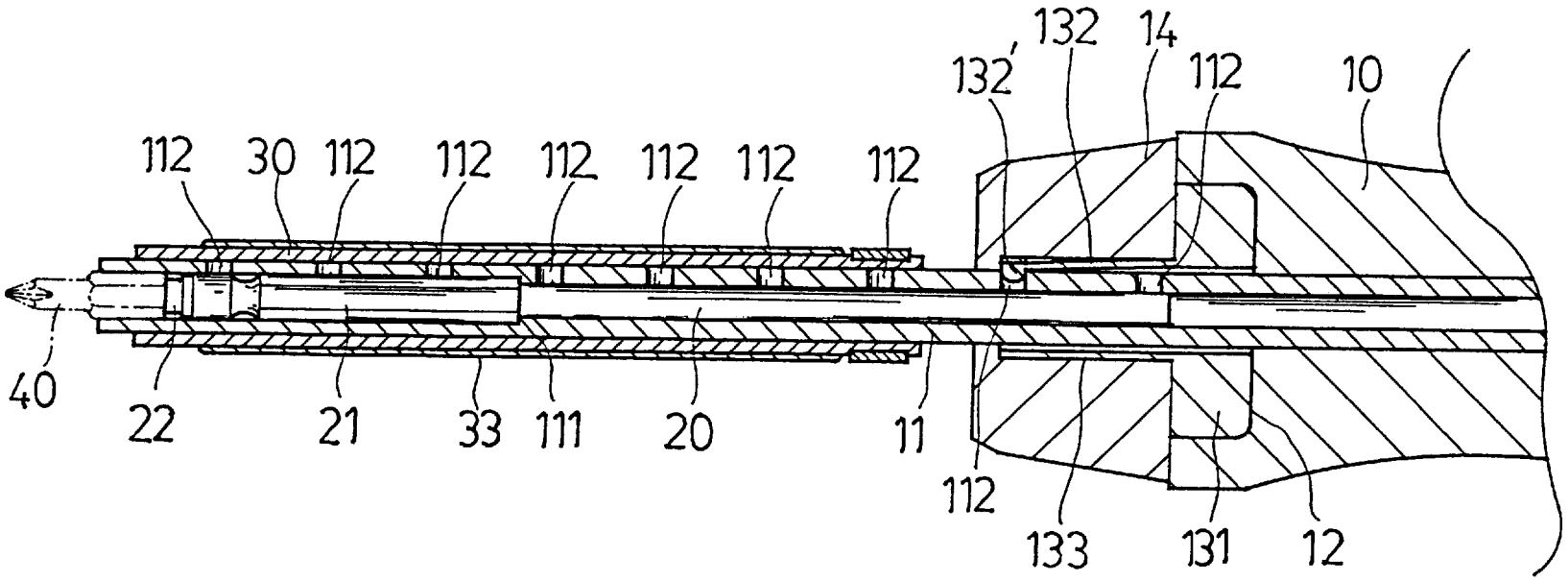
FIG. 4 is a longitudinal view in section of the present invention.
Figure 5:
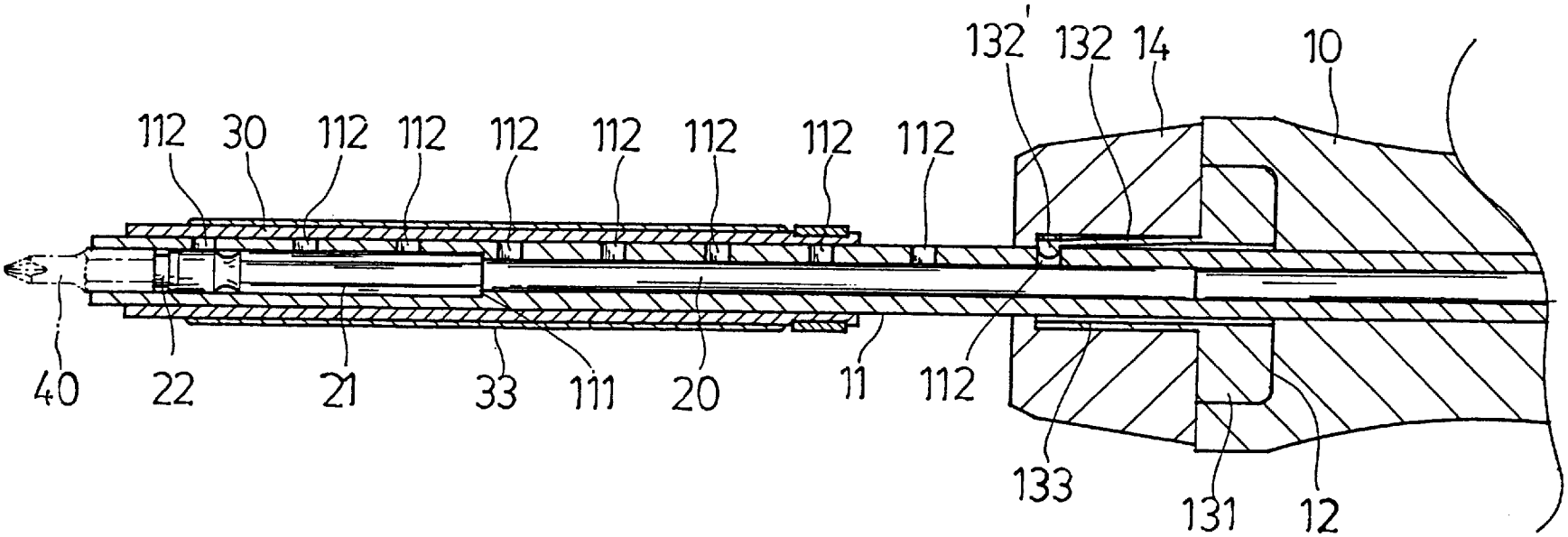
FIG. 5 is similar to FIG. 4 but showing the position of the polygonal tube changed, the total length of the screwdriver adjusted.
Figure 6:
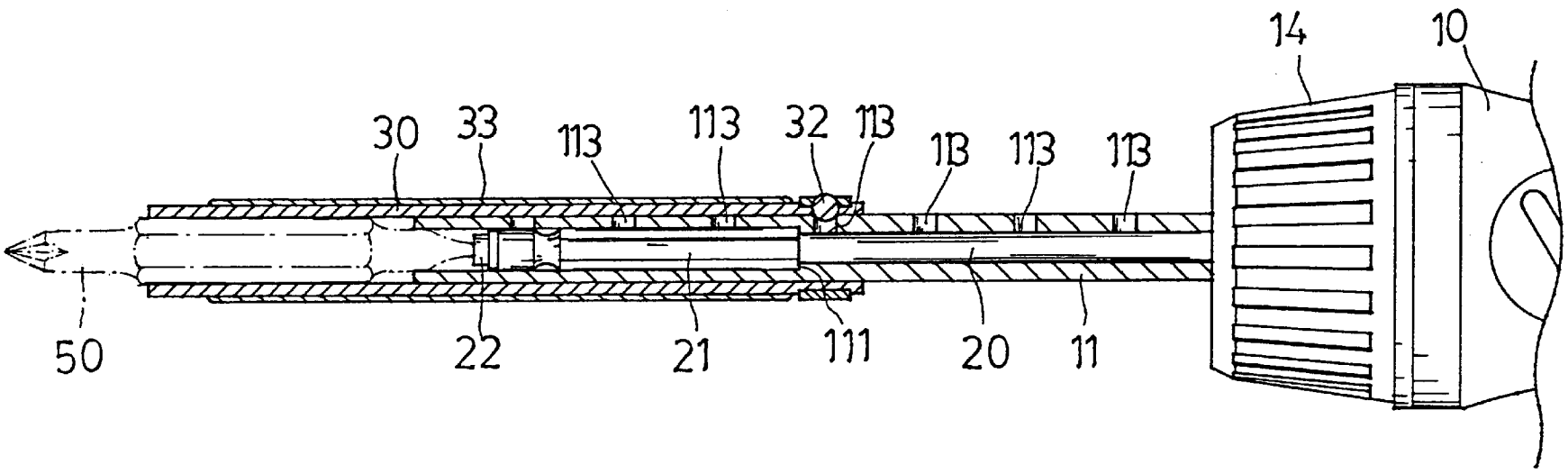
FIG. 6 is another sectional view of the present invention, showing the sleeve extended out of the polygonal tube, a big tool bit fastened to the sleeve.

Referring to FIGS. 4 and 5, the polygonal tube 11 can be moved in and out of the polygonal center hole 121 of the handle 10 to adjust the total length of the screwdriver, and a small tool bit 40 can be attached to the front end of the polygonal tube 11.

Referring to FIG. 7, the sleeve 30 can be moved relative to the polygonal tube 11 and retained thereto at the desired location, and a big tool bit 50 can be attached to the polygonal center through hole 31 of the sleeve 30 when the front end of the sleeve 30 protruding over the front end of the polygonal tube 11.

While only one embodiment of the present invention has been shown and described, it will be understood that various modifications and changes could be made thereunto without departing from the spirit and scope of the invention disclosed.

I claim:

1. A length-adjustable screwdriver comprising:

a handle having a recessed circular front hole at a front end thereof, and a polygonal center hole longitudinally disposed at the center of said recessed circular front hole;

a collar block mounted within the recessed circular front hole of said handle, said collar block having a circular base fit into the recessed front hole of said handle, a center through hole through the center of said circular base in alignment with the polygonal center hole of said handle, a tubular upright flange raised from one side of said circular base around the center through hole of said circular base, two transverse slots bilaterally disposed at the connecting area between said circular base and said upright flange, two longitudinal openings respectively and perpendicularly extended from said transverse slots, a springy strip raised from said circular base at an outer side of said upright flange facing a gap at said upright flange and having a top end terminating in a semicircular retainer head;

a polygonal tube inserted through the center through hole of said collar block into the polygonal center hole of said handle, having an inside annular flange, and two longitudinal rows of locating holes, alternatively arranged at two adjacent side walls thereof;

a chuck mounted on the front end of said handle and turned between a first position in which the retainer head of said spring strip is forced into engagement with one locating hole of said polygonal tube to secure it in place, and a second position in which the retainer head of said springy strip is released from said polygonal tube, permitting said polygonal tube to be moved in the polygonal center hole of said handle, said chuck comprising a center through hole through which said polygonal tube passes, a longitudinal groove longitudinally disposed inside its center through hole and adapted for receiving said springy strip, and two inward guide rods bilaterally and inwardly raised from the periphery of its center through hole and respectively inserted through the longitudinal openings of said collar block into the transverse slots thereof;

a shaft inserted into said polygonal tube, having one end terminating in a polygonal rod section stopped at the inside annular flange of said polygonal tube, and a magnet at the end of said polygonal rod section; and a sleeve sleeved onto said polygonal tube, said sleeve having a polygonal center through hole fitting the outer diameter of said polygonal tube, and a spring-supported ball adapted to engage one locating hole of said polygonal tube.

2. The length-adjustable screwdriver of claim 1, wherein said sleeve is covered with a soft covering.

* * * * *